United States Patent [19]

Wudyka

[11] 3,960,334

[45] June 1, 1976

[54] SIZE REDUCTION APPARATUS

[75] Inventor: Joseph Paul Wudyka, Cumberland, R.I.

[73] Assignee: Cumberland Engineering Company, Inc., South Attleboro, R.I.

[22] Filed: Feb. 24, 1975

[21] Appl. No.: 552,662

[52] U.S. Cl. ..... 241/60; 241/73

[51] Int. Cl.² ..... B02C 23/20

[58] Field of Search ..... 241/60, 65, 73, 222, 241/57

[56] References Cited

UNITED STATES PATENTS

| | | | |
|---|---|---|---|
| 2,808,997 | 10/1957 | Mulder | 241/60 |
| 3,241,776 | 3/1966 | Sheldon | 241/73 X |
| 3,419,223 | 12/1968 | Morin | 241/73 |
| 3,756,519 | 9/1973 | Reynolds et al. | 241/73 |

*Primary Examiner*—Granville Y. Custer, Jr.
*Attorney, Agent, or Firm*—Burnett W. Norton

[57] ABSTRACT

Disclosed herein is size reduction apparatus such as a granulating machine of the type for cutting plastics and the like. The granulating machine includes a chamber provided with a driven rotor having a series of cutting knives affixed on the periphery thereof. The cutting knives cooperate with stationary bed knives to comminute material fed into the cutting chamber. One or more screens are positioned in the bottom of the chamber and allow for the discharge of the material after it has been reduced to a predetermined size. A series of fluid nozzles are arranged to deliver fluid such as air under pressure into the chamber in the zone below the axis of rotation of the rotor. The air acts to effect a scrubbing of the granulator screen, improve cooling of the cutting chamber and cool the cutting knives. By such scrubbing and cooling in the area of the discharge screen heavy build up of material on top of the screen is precluded as the material is circulated and suspended. Also, melting of the thermoplastic material in the chamber is prevented.

10 Claims, 5 Drawing Figures

SIZE REDUCTION APPARATUS

The present invention relates to size reduction apparatus and relates, more particularly, to a new and improved size reduction apparatus incorporating means for injecting fluid under positive pressure into the cutting chamber of the granulator to thereby improve the efficiency of the mechanism.

BACKGROUND OF THE INVENTION

In operations such as synthetic plastic molding processes, and wire and cable reclamation where metal is separated from insulation, particularly where thermoplastics are used, scrap material is recycled by first cutting it into small pieces and then feeding it into extruders for further molding operations. To prepare the scrap material for such recycling, it is commonly fed through machines called granulators which cut the material into small pieces are of particulate size. Such machines are generally provided with a plurality of bed knives usually two, positioned around the cutting circle of a rotary cutting member which is generally plural bladed. The material to be cut up is fed into the granulator where it is cut by the cooperative action of the rotating fly knives on the rotor and the bed knives.

During the operation of such granulators when operating on thermoplastic material some plugging or blinding of the discharge screen frequently occurs. This plugging then leads to a decrease in the through-put or output of the granulator. In turn, a build-up of the material occurs in the cutting chamber resulting in an increase in temperature within the cutting chamber. Such plugging may eventually cause melting of the material being cut up. This results in stoppage of the machine and subsequent downtime for cleaning and in the more extreme situations, can even produce a fire hazard. The problem is more severe when the granulator is operated with relatively small size holes in the screen or when material with a low melting temperature is being processed, or when both effects are present in combination.

Against this background the present invention admirably provides for injecting pressurized fluid such as air into the cutting chamber of the granulator and in a direction at the rotor and generally perpendicular to the holes in the discharge screen. The rotation of the rotor interrupts the air blast causing an intermediate scrubbing of the screen to minimize dust build-up and agitate the material lying on the top of the screen. This tends to suspend or stratify the material in the air in and above the cutting chamber. Further, the introduction of this pressurized air improves the cooling of the cutting chamber and cutting knives by injecting additional cooling air and by allowing more efficient air flow due to reduced screen plugging and, in turn, cooling by the conventional air conveying discharge system. By preventing a heavy build-up of material directly on top of the screen and causing agitation within the chamber which serves to keep the material in the air stream within the hopper, the granulator is rendered more tolerant to occasional overfeeding. Plugging of the screen is essentially precluded and melting of the thermoplastic material within the cutting chamber is virtually eliminated. Thus, the overall efficiency of the granulator is markedly improved with the employment of the present invention.

OBJECTS OF THE INVENTION

It is one object of the present invention to provide size reduction apparatus equipped with means for improving the productivity of said apparatus.

Another object of the present invention is to provide size reduction apparatus incorporating means for producing a positive fluid pressure within the cutting chamber of the apparatus to suspend the material being cut in the fluid and prevent heavy build-up of the material on the top of the discharge screen.

Still a further object of the present invention is to provide size reduction apparatus incorporating means for producing a positive fluid pressure in the direction of the rotating knives of the size reduction apparatus in order to produce a pulsating fluid effect within the cutting chamber of the apparatus to cause a scrubbing of the discharge screen of the chamber and facilitate ready removal from the chamber of particulate which has been reduced to a predetermined size.

Another object of the present invention is to provide size reduction apparatus incorporating means for cooling material being comminuted to thereby preclude melting of the material as it is being processed in the apparatus.

A further object of the present invention is to provide means to effecting cooling of the rotating knives of size reduction apparatus.

Yet another object of the present invention is to provide size reduction apparatus which is of economical construction and yet durable and reliable in use.

Other objects and advantages of the invention will be apparent from the following detailed description.

DESCRIPTION OF THE PREFERRED EMBODIMENT

In brief, the present invention incorporates, in combination with a size reduction machine, i.e., a granulator, the improvement wherein a plurality of air nozzles are arranged on opposite sides of the rotor within the cutting chamber of the granulator, the nozzles being operable to expel pressurized air into the chamber and against a portion of the rotor. As is well known, the knives which are affixed on the periphery of the rotor extend outwardly to pass in close proximity to fixed bed knives within the cutting chamber. The knives on the rotor may be situated tangentially to the rotating axis of the rotor, thereby providing so-called "steep angle" knives or, in the alternative, the knives may be mounted radially with respect to the rotor axis. In either event, by virtue of the advantageous arrangement of applicant's invention, pressurized air expelled into the cutting chamber and against the rotor and its knives is caused to be pulsated by the action of the rotor and knives. This interruption of the air blast causes a scrubbing effect on the screen which acts as the discharge for the particulate leaving the cutting chamber. Accordingly, dust build-up is minimized, agitation of the material lying on top of the screen is achieved and stratification of the material in the chamber is effected. Additionally, cooling of the cutting chamber by the injected air is accomplished. All of these features lead to the prevention of a heavy build-up of material on top of the screen and cause agitation which keeps the material in the air stream in the hopper. This renders the granulator more tolerant to over-feeding and precludes melting of the thermoplastic material in the area of the screen, thus preventing the screen from being plugged. Accordingly, a high efficient granulator is provided by the present invention.

Figure 1:
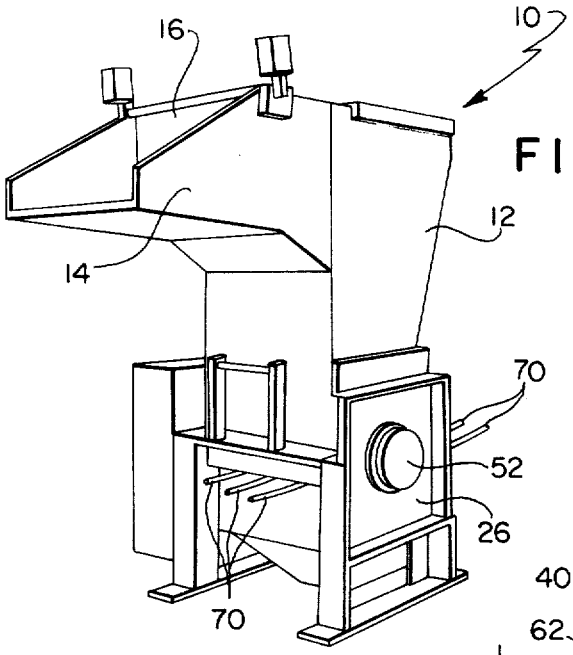
FIG. 1 is a perspective view of a granulating machine incorporating the present invention.

Turning now to FIG. 1 of the drawing there is shown a size reduction machine or as it will be called herein, a granulator, identified by the reference numeral 10. This granulator may be the same as that manufactured and sold by Cumberland Engineering Co., Inc., South Attleboro, Mass., as its Cumberland Series B granulating machine. Granulator 10 includes the usual hopper 12 into which material, say plastic pipe, film, filaments, parisons, thermo-formed parts, wire, cable and the like, are delivered through trough 14 and trough opening 16. Hopper 12 is affixed to the upper end of a relatively heavy base 18 which forms the upper region of a cutting chamber 20. The cutting chamber 20 is also defined by heavy metal fabrications constituting front and rear walls 22 and 24 respectively, and opposite heavy metal sidewalls, one of which is shown at 26 in FIG. 1. The lower end of cutting chamber 20 is defined by a screen 30 which has a plurality of screen holes or openings 32 of a predetermined size therethrough, the size being determined by the size of the particulate which will be permitted to be discharged from cutting chamber 20. The particulate granulated within cutting chamber 20 is permitted to move outward from the cutting chamber through holes 32 and be discharged downwardly through a confined throat 34.

Figure 2:
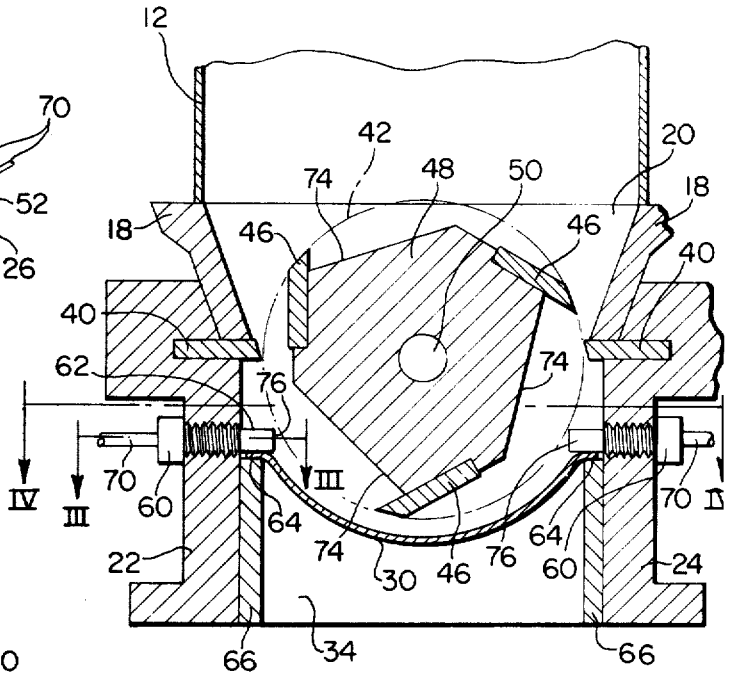
FIG. 2 is an end elevational view and cross section of the cutting chamber of the granulator of FIG. 1 illustrating the fluid pressure means in operative association with the cutting chamber.
Figure 3:
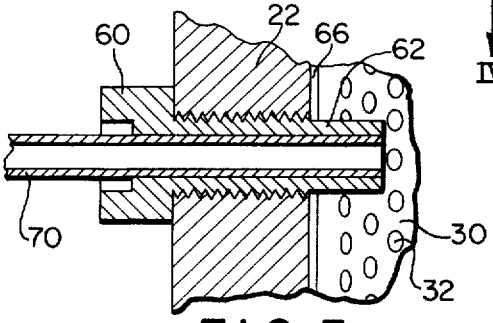
FIG. 3 is a view taken along lines III — III of FIG. 2.
Figure 4:
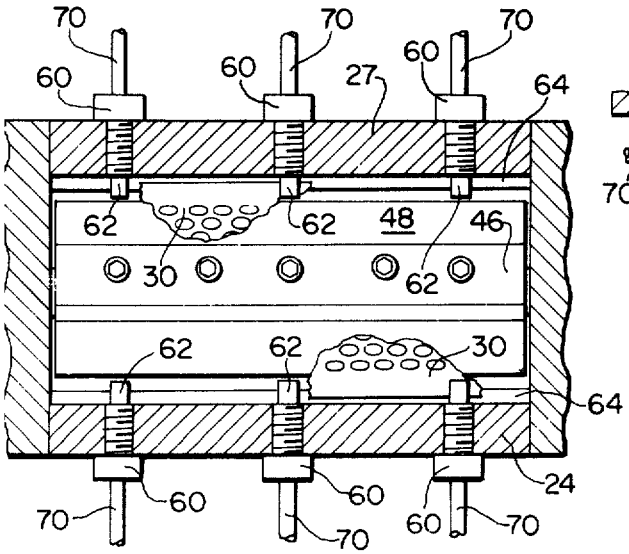
FIG. 4 is a view taken along lines IV — IV of FIG. 2.

Within cutting chamber 20 there is mounted a pair of oppositely disposed bed knives 40 which are rigidly fixed in position between base 18 and walls 22 and 24, as seen in FIG. 2. The forward end of each bed knife is arranged in close proximity to the cutting circle, identified by the broken line 42 in FIG. 2, of a plurality of rotor knives 46 secured on the outer periphery of a rotor 48. Rotor 48 is mounted for rotation about an axis constituted by a pair of relatively heavy stub shafts 50 extending from opposite ends of the rotor and being suitably engaged in pedestal bearings 52 (see FIG. 1) held in the opposite sidewalls 26. Rotor 48 is suitably driven by means such as an electric motor (not shown) with the rotor having angular speeds up to 1,200 revolutions per minute and higher. It will be understood that material delivered into cutting chamber 20 through hopper 12 encounters the cooperative cutting action of bed knives 40 and rotor knives 46, the material passing into the lower portion of cutting chamber 20, i.e., that portion of the cutting chamber lying below the opposite bed knives 40. When the material is reduced in size to a degree sufficient to pass out through the openings 32 in screen 30 it falls through throat 34 and received in by suitable means such as an airveyor system not herein illustrated.

It has already been discussed that screen 30 forms the lower boundary of cutting chamber 20. Screen 30 may be secured in position by a plurality of cap screws 60 which are screwed through tapped holes suitably formed at spaced apart locations through the front and rear walls 22 and 24 of cutting chamber 20, the interior shank 62 of each said screw overlying a flange-like end 64 bent outwardly at each end of screen 30. Thus, shank 62 of each screw 60 is operable to pinch the opposing flanges 64 of screen 30 and force these flanges into engagement with ribs 66 fastened against the interior side of front and rear walls 22 and 24, thus to hold screen 30 in its operative position below rotor 48. Quite apparently, screws 60 may be backed off to the extent where their shanks do not overlie screen 30 so that screen 30 may be readily removed for servicing and cleaning.

In the interest of convenience it has been useful to bore through the centers of one or more of these screen securing bolts 60 with those bored holes serving as a convenient seat or seats for one or more fluid delivery tubes 70. The tubes 70 are connected at their outer ends with a suitable source of compressed air and the inner end of each tube is arranged to be generally coterminus with the inner end of shank 62 of the respective bolts 60. Each tube 70 may be secured in the bore through screw 60 by any suitable means to preclude accidental lateral shifting movement of the tube during operation of the granulator. As is most evident in FIG. 2 the inner end of each tube is chordally arranged with respect to rotor 48, the air pressure delivered from each tube impacting against the lower portion of rotor 50, i.e., that zone defined below a line passing through the axial midpoint of the stub shafts 50 and below the plane of bed knives 40. Since each of the rotor knives 46 projects outwardly from the rotor, a gap or recess exists between each adjacent pair of rotor knives 46 as defined generally by the reference numerals 74. As a steady stream of air from each of the tubes 70 is expelled outwardly from the front end or nozzle 76 it moves in a path approximately perpendicular to the holes 32 in screen 30. The rotation of rotor 48 interrupts the several continuous air blasts causing a pulsating effect of the air within the chamber and thus creating a scrubbing effect by the air on screen 30. The air also acts to stratify material within the chamber. Additionally, the compressd air acts to cool the interior of the chamber and thereby prevent melting of the material, especially in the area of the holes 32 in screen 30. It will be evident that, if desired, the air could be cooled to any preselected temperature.

As is apparent in FIG. 2 nozzles 76 are chordally arranged to apply air to a first zone defined between the left hand bed knife 40 in FIG. 2 and a vertical line passing through the axis of rotation of rotor 48. A second set of nozzles 76 applies a similar positive pressure air stream against the opposite side of the rotor in a zone defined between the right hand bed knife 40, as shown in FIG. 2, and the same vertical line. In the embodiment shown in FIGS. 1–4 air injection is provided through six nozzles 76, three said nozzles being positioned to deliver air at each side of rotor 48. Quite obviously, the number of nozzles 76 can be varied in any number and type consistent with the size of the granulator and the material being cut. It has been found useful to apply air through nozzle 76 into the granulator presently being described at from 35 to 80 psi, although higher and lower pressures have been employed with success.

In a first test conducted with the present invention previously granulated ABS (three-eighths inches) was tested employing a Model 5, Series A Granulating Machine manufactured and sold by the afore-mentioned Cumberland Engineering Co., Inc. The granulator was first equipped with a screen 30 having openings therethrough of 3/32 inches and then with a screen having openings therethrough of 1/16 inches. No melting occurred and a minimum of plugging or blinding of the openings through the screen occurred during a 2 hour run with a granulator equipped with the screen configurations. When the granulator was run without the utilization of the compressed air injection means of the present invention extensive plugging and blinding of the openings through the discharge screen occurred and occasional melting of the ABS was observed within the cutting chamber. With compressed air being injected into the cutting chamber in accordance with the present invention, a higher throughput rate of the ABS was achieved and this rate remained constant within the duration of the test. Without the utilization of the compressed air injection means of the present invention a gradual decrease in the throughput rate of the granulated ABS was observed.

In a second test conducted with the present invention "SURLYN" (IONOMER Resin) was granulated in a Model 37 Granulating Machine manufactured and sold by the afore-mentioned Cumberland Engineering Co., Inc. SURLYN film has a melting temperature of approximately 220°F. The granulator was equipped with a ⅜ inch discharge screen. Compressed air injection in accordance with the present invention was made at six points, there being three equidistantly spaced nozzles on each side of the rotor in the zone below the axial midpoint of the rotor axis and below the bed knives. No melting or overheating of the film occurred during a three hour run. In a controlled test using the same equipment but without the air injection of the present invention melting of the film occurred within 20 minutes.

Figure 5:
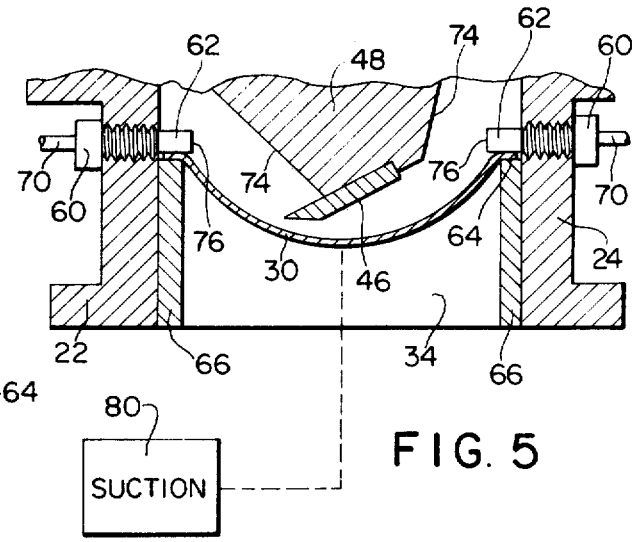
FIG. 5 is a view of an alternate embodiment of the invention.

The present invention has equal applicability to granulators of the type shown in FIGS. 1 through 4 wherein no negative pressure inducing means is provided for inducing the granulated material through discharge screen 30 and, in the arrangement as illustrated in FIG. 5. In this later figure a granulator which may be the same as that illustrated in FIG. 1 through 4 is shown. However, in FIG. 1 through 5 the granulator is seen to be equipped with suction means 80 connected via appropriate ducting 82 to present a negative pressure below discharge screen 30 so as to induce the comminuted material within cutting chamber 20 downwardly into throat 34.

From the foregoing it will be seen that the present invention admirably provides means incorporated in a granulator for comminuting thermoplastic material wherein a steady stream of fluid such as air is expelled toward one or both sides of a rotor in a zone below the rotor axis in a manner to effect agitation of the material being cut up within the cutting chamber. The air is operable to effect a scrubbing action on the screen and the motion of the rotor and its attendant knives is operative to cause the air to be pulsated. The combined actions of the air and the rotor are such as to minimize plugging or blinding of the discharge screen of the granulator. The air is also operative to preclude the thermoplastic material from melting within the chamber by virtue of the stratifying effect of the air. Additionally, the air assists in cooling the rotor knives, thereby extending their life. If desired the air may be cooled to any preselected temperature to further minimize the possibility of melting of the material as it is processed within the cutting chamber. Further, the air acts as a means for expelling the material through the openings in the discharge screen. From all of the foregoing it will be most evident that the present invention provides a novel and advantageous improvement in granulators, permitting increased productivity of the granulator while minimizing downtime required for cleaning and unplugging the granulator.

Since certain changes may be made in the above apparatus without departing from the scope of the invention herein involved, it is intended that all matter contained in the above description or shown in the accompanying drawing shall be interpreted as illustrative only and not in a limiting sense.

What is claimed is:

1. Size reduction apparatus comprising, a chamber, a rotor mounted within said chamber for rotation about an axis, means for driving said rotor about said axis, cutting means affixed on said rotor, bed knife means situated for cooperative cutting relationship with said cutting means as said rotor is driven to effect size reduction of material fed into said chamber, screen means forming at least a portion of a boundary of said chamber, said screen means serving to permit discharge from said chamber of said material after reduction thereof to a predetermined size, and means positioned below the axis of rotation of said rotor for producing a positive fluid flow in said chamber.

2. Apparatus as set forth in claim 1 wherein said cutting means includes a plurality of knives positioned around the circumference of said rotor with a gap being provided between adjacent knives, said means for producing said positive flow being situated to direct said flow toward said knives.

3. Apparatus as set forth in claim 1 wherein said rotor is elongated and said cutting means includes a plurality of elongated knives positioned around the circumference of said rotor and extending generally from end to end of the rotor, and said means for producing said positive flow includes a plurality of fluid jets positioned at spaced apart locations to direct said flow toward said knives.

4. Apparatus as set forth in claim 1 wherein said screen means includes at least one screen forming at least a portion of the bottom of said chamber, said positive fluid flow being presented into said chamber and said screen and toward said rotor.

5. Apparatus as set forth in claim 4 wherein said cutting means includes a plurality of knives movable through a cutting path as said rotor is driven, said screen being disposed proximate to said cutting path, an said means for producing said positive flow being located closely adjacent to said cutting path whereby fluid delivered from said last mentioned means is caused to be pulsed by said knives as said fluid moves through said chamber and out through said screen.

6. Apparatus as set forth in claim 5 wherein said means for producing said positive flow are fluid nozzles.

7. Apparatus as set forth in claim 6 wherein a first set of said jets is arranged to direct fluid toward said rotor in a first zone defined between a first of said bed knife means and a vertical line passing through the axis of rotation of said rotor, and a second set of said jets is arranged to deliver fluid toward said rotor in a second zone defined between a second of said bed knife means and said vertical line.

8. Apparatus as set forth in claim 7 including suction means for creating a negative pressure below said screen.

9. Apparatus as set forth in claim 7 wherein said fluid is air.

10. Apparatus as set forth in claim 9 wherein said fluid is introduced into said chamber in a steady stream.

* * * * *